US005152601A

United States Patent [19]

Ferng

[11] Patent Number: 5,152,601

[45] Date of Patent: Oct. 6, 1992

[54] SOLAR POWER-OPERATED CONSTRUCTION WORK WARNING LAMP

[76] Inventor: Shing-Lai Ferng, 29, Her Lih St., Taipeng, Taichung, Taiwan

[21] Appl. No.: 837,050

[22] Filed: Feb. 18, 1992

[51] Int. Cl.[5] ..... F21L 9/00

[52] U.S. Cl. ..... 362/183; 362/186; 362/235; 362/276; 362/363

[58] Field of Search ..... 362/157, 183, 186, 276, 362/363, 802, 227, 235, 249; 340/908.1, 600

[56] References Cited

U.S. PATENT DOCUMENTS

| | | | |
|---|---|---|---|
| 3,818,439 | 6/1974 | Main | 362/455 |
| 4,481,562 | 11/1984 | Hickson | 362/183 |
| 4,580,201 | 4/1986 | Williams | 362/363 |
| 4,751,622 | 6/1988 | Williams | 362/186 |
| 5,062,028 | 10/1991 | Frost et al. | 362/183 |
| 5,081,568 | 1/1992 | Dong et al. | 362/183 |

*Primary Examiner*—Richard R. Cole

*Attorney, Agent, or Firm*—Bucknam and Archer

[57] ABSTRACT

A solar power-operated, construction work warning lamp comprising a base covered by a bottom cover to hold a power supply control circuit and a column, the power supply control circuit consisted of a storage battery, a power switch and an IC board, the column having a plurality of LEDs thereon respectively connected to the power supply control circuit, a lamp guard mounted on the base at the top and covered with a transparent, convex cover, a solar cell assembly supported on the column inside the lamp guard and electrically connected to the power supply control circuit, and a plurality of reflectors mounted on a plurality of openings around the lamp guard, wherein the radiant energy of sunlight collected by the solar cell assembly is converted into electric power for charging the storage battery and for driving the light emitting elements to flash signals by means of the control of the IC board and the power switch.

2 Claims, 3 Drawing Sheets

SOLAR POWER-OPERATED CONSTRUCTION WORK WARNING LAMP

BACKGROUND OF THE INVENTION

The present invention relates to warning lamps, more particularly, the present invention relates to a solar power-operated warning lamp for use in a construction work.

In a construction work, more particularly in a road construction work, warning lamps shall be installed at the job-site so as to give warning of danger to passers-by day and night. Because warning lamps are exposed to the open air, the electric circuit thereof may be damped easily during bad weather conditions (raining or snowing), causing short circuit problem. Therefore, regular construction work warning lamps are not safe in use.

The present invention has been accomplished under the aforesaid circumstances. It is therefore the object of the present invention to provide a warning lamp for use in construction works, which is safe in use under all weather conditions. According to the present invention, a solar power-operated warning lamp is generally comprised of a base covered by a bottom cover to hold a power supply control circuit and a column, said power supply control circuit consisted of a storage battery, a power switch and an IC board, said column having a plurality of LEDs thereon respectively connected to said power supply control circuit, a lamp guard mounted on said base at the top and covered with a transparent cover, a solar cell assembly supported on said column inside said lamp guard and electrically connected to said power supply control circuit, and a plurality of reflectors mounted on a plurality of openings around said lamp guard. Radiant energy of sunlight is collected by the solar cell assembly and then, converted into electric power for charging the storage battery and for driving the light emitting elements to flash signals by means of the control of the IC board and the power switch. Light emitting diodes are preferably used for the light emitting elements.

DETAILED DESCRIPTION OF THE PREFERRED EMBODIMENT

Figure 1:
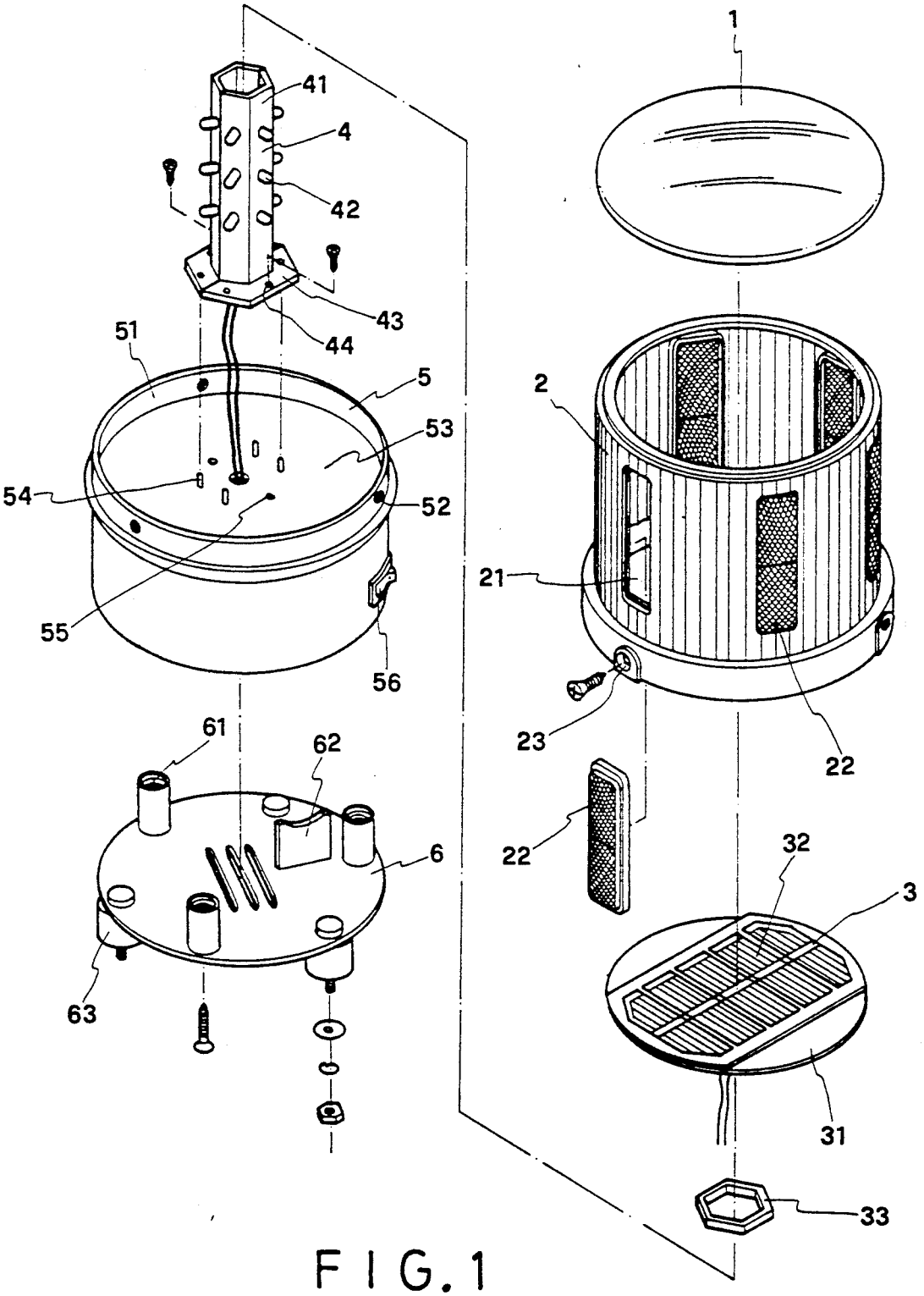
FIG. 1 is an exploded view of a solar power-operated construction work warning lamp embodying the present invention.
Figure 2:
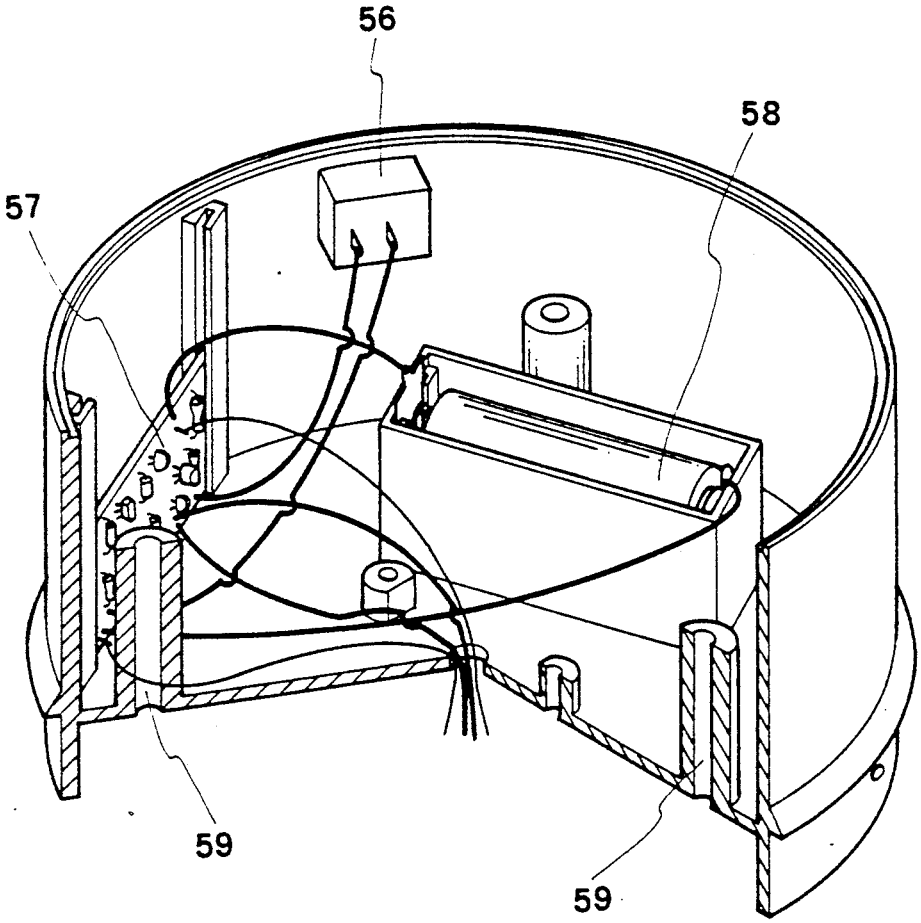
FIG. 2 is a partly cut-off view of the base (in an inverted position) thereof.

Referring to FIGS. 1 and 2, a solar power-operated, construction work warning lamp is generally comprised of a top cover 1, a lamp guard 2, a solar cell assembly 3, a column 4, a base 5, and a bottom cover 6.

The top cover 1 is made from a transparent material having a top surface curving outwards. After having been covered on the lamp guard 2 at the top edge thereof, the peripheral edge of the top cover 1 is sealed to peripheral top edge of the lamp guard 2 through an adhesive joint, and therefore, water is prohibited from entering the lamp guard 2.

The lamp guard 2 is made from a hollow transparent cylinder having a plurality of openings 21 equidistantly spaced around the peripheral wall thereof, a plurality of reflector 22 respectively mounted on the openings 21, and a plurality of fastening holes 23 around the peripheral bottom edge thereof for fastening the base 5.

The solar cell assembly 3 is comprised of a base board 31 having a plurality of solar cells 32 attached to the top edge thereof for collecting the radiant energy of sunlight, and a loop flange 33 on the bottom edge thereof for fastening the column 4. The solar cells 32 are connected to an IC (integrated circuit) board 57 inside the base 5. By means of the operation of the IC board 57, the radiant energy of sunlight collected by the solar cells 32 is converted into electric power for charging a storage battery 58 which is also set inside the base 5. The storage battery can be a nickel-cadmium battery which has the capability of storing electric power and can be controlled to discharge it.

The column 4 is formed by connecting two symmetrical parts 41 together with a plurality of light emitting elements 42 mounted thereon. In the present preferred embodiment. Light emitting diodes (LEDs) are used for the light emitting elements 42 so that electric power consumption can be minimized. The light emitting elements 42 are connected to the IC board 57 through an electric circuit. The column 4 has holes 44 around the bottom flange 43 thereof for securing to the base 5.

The base 5 is made in a cylindrical shape having one end opened and an opposite end closed by a cover board 53. As illustrated, the base 5 has a top ring 51 inserted into the lamp guard 2 at the bottom, which top ring 51 has a plurality of holes 52 around the peripheral wall thereof respectively secured to the fastening holes 23 by screws. The cover board 53 of the base 5 has a plurality of top tenons 54 and holes 55 corresponding to the holes 44 on the bottom flange 43 of the column 4. By inserting the top tenons 54 into corresponding holes 44 on the bottom flange 43 of the column 4 and connecting the holes 55 to corresponding holes 44 by screws, the column 4 is firmly secured to and supported on the cover board 53 of the base 5. Further, there is provided an On/Off switch 56 on the base 5 for controlling the internal circuit of the warning lamp. The base 5 further comprises a plurality of bolt sleeves 59 vertically extending downwards from the cover board 53 for fastening the bottom cover 6.

The bottom cover 6 is made in such a size fitting the base 5, having a plurality of bolt sleeves 61 and a supporting board 62 on the top edge thereof for connecting to the bolt sleeves 59 on the cover board 53 by screws or retaining the storage battery 58 in place, and a support plurality of legs 63 on the bottom edge thereof for supporting on a lamp support or the ground in a construction work.

The assembly process of the warning lamp is outlined hereinafter. Fasten the reflector 22 in the openings 21 and attach the top cover 1 to the lamp guard 2, and water-tightly seal them in place by an adhesive agent. Then, attach the solar cells 32 to the base board 31 and extend the two opposite lead wires of the solar cells 32 out of the solar cell assembly 3 through the loop flange 33. As soon as the two opposite parts 41 are connected together, the column 4 is then secured to the cover board 53 of the base 5 by mounting the holes 44 to the tenons 54 or connecting the holes 44 to holes 55 by screws. Then, attaching the loop flange 33 of the solar cell assembly 3 to the column 4, and securing the lamp guard 2 to the base 5. Then, turn the base 5 and the lamp guard 2 upside-down, and solder the lead wires of the solar cells 32 to the IC board 57, and then, electrically connect the IC board 57 to the On/Off switch 56 and the storage battery 58. As soon as the base cover 6 has been secured to the base 5 by screws, the warning lamp is well assembled.

Figure 3:
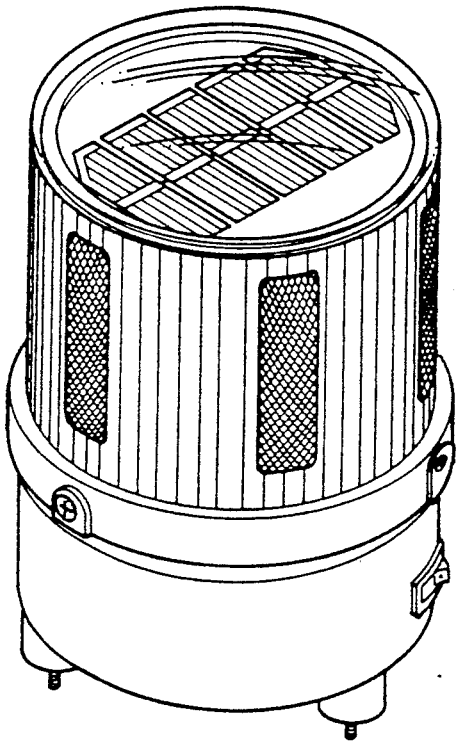
FIG. 3 is an elevational view of the warning lamp.

Referring to FIG. 3, the warning lamp has a water-tightly enclosed cylindrical body convenient for installation at the job-side of a construction work. During the day, the solar cell assembly 3 collect the radiant energy of sunlight permitting it to be converted into electric power for charging the storage battery 58. During the night or under a dark condition, the light emitting elements 42 are controlled by the IC board 57 to flash signals intermittently. At the same time, the reflectors 22 reflect the light from any external light source so as to give warning of danger to the moving objects at approach.

As indicated, the present invention is to provide a solar power-operated, construction work warning lamp which utilizes a solar cell assembly to collect the radiant energy of sunlight and convert it into electric power for charging a storage battery so that the LEDs thereof flash signals during the night to give warning of danger to the moving objects at approach. However, it is to be understood that the drawings are designed for purposes of illustration only, and are not intended as a definition of the limits and scope of the invention disclosed.

What is claimed is:

1. A solar power-operated construction work warning lamp comprising:

a top cover, said top cover being made from a transparent material having a top surface curving outwards;

a lamp guard, said lamp guard being made from a hollow transparent cylinder having a top opening covered by said top cover, a plurality of openings equidistantly spaced around a peripheral wall thereof and respectively covered with a plurality of reflectors, and a plurality of fastening holes around a peripheral bottom edge thereof;

a solar cell assembly, said solar cell assembly comprised of a flat base board having a plurality of solar cells on a top edge thereof disposed inside said lamp guard below said top cover, and a loop flange on a bottom edge thereof;

a column formed by connecting two symmetrical parts together with a plurality of light emitting elements mounted thereon, said column being secured to said loop flange at the bottom, and having holes around a bottom flange thereof;

a base made in a cylindrical shape having one end opened and an opposite end closed by a cover board, said base having a plurality of holes around a top ring thereof respectively connected to the fastening holes on the peripheral bottom edge of said lamp guard, said cover board having a plurality of top tenons and holes respectively connected to the holes on the bottom flange of said column permitting said column to be supported between said cover board and said loop flange of said solar cell assembly;

a bottom cover covered on said base at the bottom;

a power supply control circuit fastened inside said base and connected to said solar cell assembly via said light emitting elements, said power supply control circuit being comprised of an IC board, a storage battery and a power switch;

wherein the radiant energy of sunlight collected by said solar cell assembly is converted into electric power for charging said storage battery, by means of the operation of said IC board, so as to further drive said light emitting elements to flash signals intermittently by means of the control of said IC board and said power switch.

2. The warning lamp of claim 1, wherein said light emitting elements are formed of light emitting diodes.

* * * * *